US008618445B2

(12) United States Patent
Dubey et al.

(10) Patent No.: US 8,618,445 B2
(45) Date of Patent: Dec. 31, 2013

(54) HEATING SYSTEM

(75) Inventors: Ashish Dubey, Grayslake, IL (US); David B. McDonald, Glenview, IL (US); James M. Ullett, McHenry, IL (US)

(73) Assignee: United States Gypsum Company, Chicago, IL (US)

( * ) Notice: Subject to any disclaimer, the term of this patent is extended or adjusted under 35 U.S.C. 154(b) by 999 days.

(21) Appl. No.: 12/560,972

(22) Filed: Sep. 16, 2009

(65) Prior Publication Data

US 2010/0065543 A1 Mar. 18, 2010

Related U.S. Application Data

(60) Provisional application No. 61/097,323, filed on Sep. 16, 2008, provisional application No. 61/176,787, filed on May 8, 2009.

(51) Int. Cl.
*H05B 3/06* (2006.01)

(52) U.S. Cl.
USPC ..... 219/213; 392/407; 392/436

(58) Field of Classification Search
USPC ..... 219/213, 520; 392/407
See application file for complete search history.

(56) References Cited

U.S. PATENT DOCUMENTS

| | | | |
|---|---|---|---|
| 2,680,800 | A | 6/1954 | Chandler |
| 2,799,764 | A | 7/1957 | Chandler |
| 3,417,229 | A | 12/1968 | Shomphe et al. |
| 3,546,432 | A | 12/1970 | Eisler |
| 4,229,329 | A | 10/1980 | Bennett |
| 4,360,554 | A | 11/1982 | Campbell et al. |
| 4,374,670 | A | 2/1983 | Slocombe |
| 4,429,214 | A | 1/1984 | Brindley et al. |
| 4,494,990 | A | 1/1985 | Harris |
| 4,518,548 | A | 5/1985 | Yarbrough |
| 4,588,443 | A | 5/1986 | Bache |
| 4,714,722 | A | 12/1987 | Najvar et al. |
| 4,725,632 | A | 2/1988 | Vess |

(Continued)

FOREIGN PATENT DOCUMENTS

| | | |
|---|---|---|
| JP | 2000-028155 | 1/2000 |
| JP | 2002-050459 | 2/2002 |
| JP | 03-132051 | 5/2007 |
| KR | 10-2004-0015657 | 2/2004 |

OTHER PUBLICATIONS

The Sydney Morning Herald; May 28, 1987; It Flies . . . Here's Concrete Evidence; Clemson University Concrete Canoe Team "Instinct".

*Primary Examiner* — Marc Armand
(74) *Attorney, Agent, or Firm* — Greer, Burns & Crain, Ltd.; Pradip Sahu; Philip T. Petti

(57) ABSTRACT

A heating system which may include a bonding membrane having a water permeable lamina, an electrically conductive ink-based radiant heater, and a first adhesive adapted to adhere to both the conductive ink-based radiant heater and the bonding membrane. The heating system may be incorporated in a floor including a substrate, the heating system and a decorative floor surface. The heating system may also be in the form of a multilayer panel having a bonding membrane, an electrically conductive ink-based heater including a plurality of electrically resistive strips printed on a first polymer sheet connected by electrically conductive buses, and electrical conductors extending from the buses to at least an edge of the panel.

20 Claims, 3 Drawing Sheets

(56) References Cited

U.S. PATENT DOCUMENTS

| | | | |
|---|---|---|---|
| 4,852,316 | A | 8/1989 | Webb |
| 5,192,366 | A | 3/1993 | Nishioka et al. |
| 5,308,397 | A | 5/1994 | Whatcott |
| 5,318,832 | A | 6/1994 | Fishel et al. |
| 5,346,550 | A | 9/1994 | Kunzi et al. |
| 5,401,588 | A | 3/1995 | Garvey et al. |
| 5,403,414 | A | 4/1995 | Corston |
| 5,439,518 | A | 8/1995 | Francis et al. |
| 5,481,838 | A | 1/1996 | Fishel et al. |
| 5,549,859 | A | 8/1996 | Andersen et al. |
| 5,584,950 | A | 12/1996 | Gaffigan |
| 5,603,758 | A | 2/1997 | Schreifels, Jr. et al. |
| 5,725,652 | A | 3/1998 | Shulman |
| 5,894,700 | A | 4/1999 | Sweet |
| 5,924,252 | A | 7/1999 | Deike |
| 5,927,034 | A | 7/1999 | Cole |
| 5,932,124 | A | 8/1999 | Miller et al. |
| 5,965,257 | A | 10/1999 | Ahluwalia |
| 6,015,965 | A | 1/2000 | Miller et al. |
| 6,017,830 | A | 1/2000 | Brown et al. |
| 6,087,630 | A | 7/2000 | Miller et al. |
| 6,124,571 | A | 9/2000 | Miller et al. |
| 6,167,668 | B1 | 1/2001 | Fine et al. |
| 6,171,388 | B1 | 1/2001 | Jobbins |
| 6,308,482 | B1 | 10/2001 | Strait |
| 6,455,615 | B2 | 9/2002 | Yu et al. |
| 6,500,560 | B1 | 12/2002 | Kiik et al. |
| 6,537,366 | B1 | 3/2003 | Supplee, Sr. |
| 6,569,923 | B1 | 5/2003 | Slagter |
| 6,586,066 | B1 | 7/2003 | Buckwalter et al. |
| 6,586,353 | B1 | 7/2003 | Kiik et al. |
| 6,599,599 | B1 | 7/2003 | Buckwater et al. |
| 6,673,177 | B2 | 1/2004 | Buckwalter et al. |
| 6,720,068 | B1 | 4/2004 | Vanbemmel et al. |
| 6,803,099 | B1 | 10/2004 | Anspach |
| 6,837,014 | B2 | 1/2005 | Virtanen |
| 7,347,895 | B2 | 3/2008 | Dubey |
| 7,415,807 | B2 | 8/2008 | O'Leary et al. |
| 2002/0170648 | A1 | 11/2002 | Dinkel |
| 2003/0004246 | A1 | 1/2003 | Wache et al. |
| 2004/0077247 | A1 | 4/2004 | Schmidt et al. |
| 2004/0129365 | A1 | 7/2004 | Buckwalter et al. |
| 2004/0175164 | A1* | 9/2004 | Loktev et al. ..... 392/436 |
| 2004/0197544 | A1 | 10/2004 | Ramesh et al. |
| 2004/0204516 | A1 | 10/2004 | DeFord et al. |
| 2005/0067095 | A1* | 3/2005 | Hasenoehrl et al. ..... 156/276 |
| 2005/0214500 | A1 | 9/2005 | Hallows |
| 2006/0054059 | A1 | 3/2006 | Dubey et al. |
| 2006/0289000 | A1 | 12/2006 | Naylor |
| 2007/0039609 | A1* | 2/2007 | Huebner et al. ..... 126/570 |
| 2008/0020662 | A1 | 1/2008 | Strait |
| 2008/0056694 | A1 | 3/2008 | Cooper |
| 2008/0060299 | A1 | 3/2008 | Dubey et al. |
| 2008/0104917 | A1 | 5/2008 | Whelan et al. |
| 2008/0121461 | A1 | 5/2008 | Gross et al. |
| 2008/0163586 | A1 | 7/2008 | Goulet et al. |
| 2008/0176022 | A1 | 7/2008 | Payne et al. |

* cited by examiner

HEATING SYSTEM

This application claims priority to provisional application Ser. Nos. 61/097,323 filed Sep. 16, 2008 and 61/176,787 filed May 8, 2009, and incorporated herein by reference in their entireties for all purposes. Patent application entitled "Electrical Heater With A Resistive Neutral Plane" filed simultaneously herewith and including related subject matter is also incorporated herein by reference in its entirety for all purposes.

FIELD OF THE INVENTION

This invention relates to heaters that can be installed in buildings such as under conventional decorative flooring. Further, this invention relates to a floor heating system that can be used in wet environments, such as kitchens and bathrooms.

BACKGROUND OF THE INVENTION

The use of heating elements in flooring provides a combination of beauty and comfort. Heated floors in cool areas of a building can provide supplemental heat to the space that is evenly distributed. In homes, warmed floors in a bathroom are kind to an occupant's feet, especially on a cold winter morning.

Several techniques are known to create heated floors. In some applications, heating elements are installed under the subfloor, between floor joists. Using this technique, the heating elements warm the air space under the subfloor, the subfloor and the decorative floor, as well as any mastic, grout or underlayment that may be present. A relatively small percentage of the power used to generate heat actually comes through to the top surface of the decorative floor to be enjoyed by the room occupants. This technique also cannot be used during a remodeling project unless a homeowner is willing to replace the subfloor or ceiling, which is an expensive project.

Heating wires can be embedded in a mortar layer. A second mortar layer is applied to hold ceramic tiles in place. Wires are placed on the subfloor in a custom configuration. The mortar must be sufficiently thick to cover the wires, changing the depth of the floor. Finally, special precautions must be taken by the applicators not to scratch or nick the wires while applying the second layer of mortar. Installation of this type of system is laborious and expensive.

Woven wire mesh heaters having no busses are made whereby thin wires are woven into a mesh mat. The mat can be placed under a laminate floor or under a subfloor. However, these mats must be custom made to fit odd-sized spaces and cannot be altered at the job site. This increases the cost of the heaters and installation, and makes the process of changing the heater layout during installation significantly more difficult.

Polymer-based heaters are made using electrically resistive plastics. A conductive bus on either side of the resistance heaters completes the circuit. The result is a cuttable heating surface; however currently available products exhibit significant thickness.

Conductive ink-based heaters are made from resistive inks printed on plastic sheets. A conductive bus on either side of the resistance heaters completes the circuit. A second plastic sheet is then placed over the circuit to protect the heating elements. The result is a thin, flexible, cuttable heating surface. Conductive ink-based are known for use under laminate floors, where they lay unattached in the space between the floor boards and the subfloor or, in the case of a remodel, an old floor. The plastic sheets that protect the device provide a poor surface for adhesion of ceramic tiles.

Thus, it would be advantageous to be able to utilize a polymer-based heater under ceramic tiles if a system could be devised where there is the proper adhesion between the heater and the tile. The flooring system should be inert to water penetration for use in wet environments, such as a kitchen or bathroom. Further, the system should be cuttable in the field, allowing the exact shape of the heater to be varied as it is being installed and to minimize cost.

SUMMARY OF THE INVENTION

A heating system is provided, which, in an embodiment includes a bonding membrane having a water permeable lamina, an electrically conductive ink-based radiant heater; and a first adhesive adapted to adhere to both the conductive ink-based radiant heater and the bonding membrane. The heating system may be incorporated into a thin and flexible panel.

The bonding membrane may include a basemat and a coating. In an embodiment, the coating comprises at least 55% of a hydraulic component such as fly ash and silica fume. The fly ash may be a Class C fly ash. The coating might further be a water-soluble, film-forming polymer. The hydraulic component may be present as a crystal matrix. The water-soluble, film-forming polymer may be present as a matrix of film strands. The crystal matrix may interlock with and be distributed throughout the matrix of film strands. The coating might further be a filler such as perlite, sand, talc, mica, calcium carbonate, clay, pumice, volcanic ash, rice husk ash, diatomaceous earth, slag, metakaolin, pozzolanic materials, expanded perlite, glass microspheres, ceramic microspheres, plastic microspheres or combinations thereof. The basemat may be a meltblown lamina sandwiched between two spunbond laminae.

The conductive ink-based radiant heating element may further comprise a polyester sheet onto which resistive strips have been printed with a conductive ink. The conductive ink may be formed with at least one of carbon and silver.

In an embodiment, at least two buses are provided to supply current to or remove current from the resistive strips. In some embodiments, at least three buses are provided to supply current to or remove current from the resistive strips. The buses may be made of any material having good electrical conductivity such as copper foil strips.

In an embodiment, a conductive material may be provided between the resistive strips and the buses.

In an embodiment, a multi-functional layer is adhered to the radiant heater using a second adhesive. The multi-functional layer may be at least one of a low density foam, a polymeric sheet, a rubber sheet and combinations thereof.

In an embodiment, the invention is a floor including a substrate, a heating system and a decorative floor surface. The heating system might include a bonding membrane having a water permeable lamina, an electrically conductive ink-based radiant heater, and a first adhesive adapted to adhere to both the conductive ink-based radiant heater and the bonding membrane.

In an embodiment, the decorative floor surface may be laminate flooring or wood flooring. In another embodiment, the decorative floor surface may be ceramic tile. With ceramic tile, the floor may also include an adhesive positioned between the subfloor and the heating system and a mortar between the heating system and the ceramic tile.

In an embodiment, the substrate may be wood, cement, linoleum, ceramic tiles or combinations thereof.

In an embodiment, the bonding membrane includes a basemat and a coating. The coating may be at least 55% of a hydraulic component such as fly ash, silica fume or combinations thereof.

In an embodiment, the invention provides a heating system in the form of a multilayer panel. The panel may include a bonding membrane, an electrically conductive ink-based heater including a plurality of electrically resistive strips printed on a first polymer sheet connected by electrically conductive buses, and electrical conductors extending from the buses to at least an edge of the panel for receiving a connection to another conductor, such as a wire, or the conductors may themselves extend beyond the edge of the panel, such as in a wiring harness.

In an embodiment, the plurality of resistive strips may be arranged parallel to one another and terminate at ends spaced from a perimeter edge of said polymer sheet.

In an embodiment, two buses are provided, one at each end of said resistive strips. The buses may be copper strips that terminate at ends spaced from a perimeter edge of the polymer sheet.

In an embodiment, the first polymer sheet may be a polyester sheet. In an embodiment, the resistive strips may be a carbon-based ink.

In an embodiment, a conductive material, such as a conductive polymer, may be positioned between the resistive strips and the buses, to assure a good connection therebetween.

In an embodiment, a second polymer sheet is provided to overlie the resistive strips and buses. Further, two additional plastic sheets may be provided to encapsulate the first and second polymer sheets and the resistive strips and buses. In some embodiments, only one additional plastic sheet may be provided to overlay either the first or the second polymer sheet. In some embodiments, the plastic sheets may be water impermeable.

In an embodiment, the bonding membrane may be a basemat and a coating formed from a mixture of a hydraulic component, a polymer and water. The hydraulic component may be at least 55% fly ash. The polymer may be a water-soluble, film-forming polymer.

In an embodiment, the basemat may be a first spunbond lamina, a second spunbond lamina and a meltblown lamina between the first and second spunbond laminae.

In an embodiment, a multi-functional layer may be included in the multilayer panel that is adhered to the radiant heater using a second adhesive. The multi-functional layer of may be thermal insulation, sound suppression material, waterproofing material, electrical insulation or crack isolation material. The multi-functional layer may be one of a low density foam, a polymeric sheet, a rubber sheet or combinations thereof.

In an embodiment, the panel includes a layer of adhesive material on one outer surface.

In an embodiment, the electrical conductors include a portion of the buses that extend to the edge of the panel.

In an embodiment, an adhesive may be arranged between the bonding membrane and the polymer sheet of the conductive ink-based heater.

DETAILED DESCRIPTION OF THE PREFERRED EMBODIMENTS

In an embodiment of the invention, a heating system 20 is provided in the form of a multilayer panel 22. The panel 22 may be thin and flexible with each of the layers not being thicker than 1 to 200 mils. The heating system 20 can be used in a variety of different locations for providing heat to that location. One such location is to use the heating system 20 in a floor. Although the present invention is not limited to such a location, and could also be used in walls, ceilings and other locations, for purposes of providing a description of an embodiment of the invention, it will be described in such a location.

Figure 1:
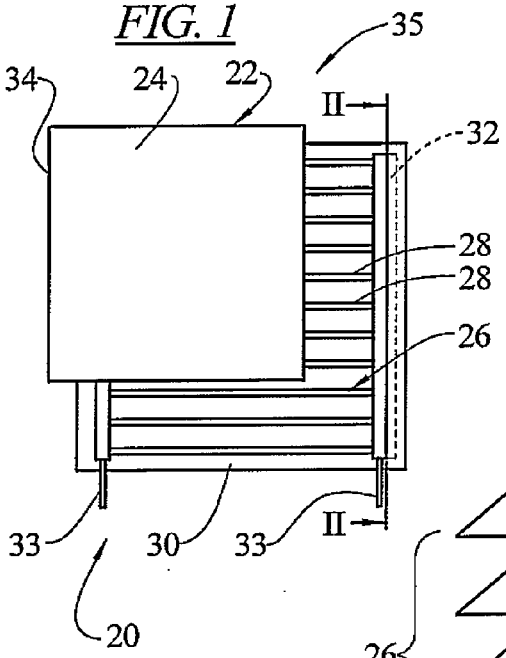
FIG. 1 is a top view of the heating system of the present invention with a portion of the bonding membrane cut away for visibility.

One of the layers of the panels 22 is a bonding membrane 24 (partially shown in FIG. 1). Another layer is an electrically conductive resistance heater 26. A first adhesive 27 adapted to adhere to both the bonding membrane 24 and the heater 26 may be positioned between the bonding membrane and the heater. In an embodiment, the adhesive 27 could be any adhesive that is compatible with cyclic temperature, moisture and possesses suitable bond strength. Suitable adhesives include transfer tapes from 3M, such as 300LSE Transfer film, 468 MP/200 MP Adhesives transfer film and 467 MP/200 MP Adhesives transfer film. Other suitable heat cured or liquid adhesives are envisioned.

The heater 26 in some embodiments may be a conductive ink-based radiant heater that includes a plurality of electrically resistive ink-based strips 28 printed on a first polymer sheet 30 which may be connected by electrically conductive buses 32. The use of individual strips allows the heater 26 to maintain a relatively high resistance since for any given ink, the wider the strip (up to the full width of the polymer sheet 30) the lower the resistance. Electrical conductors 33 such as wires may extend from the buses 32 to at least a perimeter edge 34 of the panel 22 or beyond. The conductors 33 may also be extensions of the buses 32 or conductors other than wires or the buses.

The panel 22 may be formed with a rectangular perimeter as shown in FIG. 1, or may have other shapes as desired. If formed in a rectangular shape, it may have one of a variety of different sizes, depending on the application for the panel. For example, panels may be provided having a width of 12 inches or 18 inches, or a multiple of 12 inches or 18 inches, or panels may be provided having a width of 25 centimeters or a multiple of 25 centimeters. Also, panels 22 may be provided having a length of 12 inches or 18 inches, or a multiple of 12 inches or 18 inches, or panels may be provided having a length of 25 centimeters or a multiple of 25 centimeters.

Figure 2:
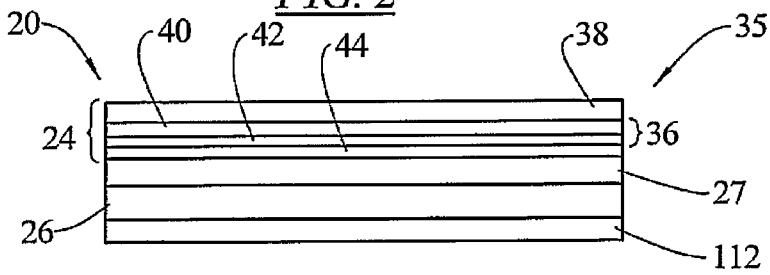
FIG. 2 is a cross-section of the heating system of FIG. 1 taken along line II-II.

Referring to FIGS. 1 and 2, a heating system, generally 35, includes the conductive heater 26, and the bonding membrane 24. The heating system 35 is supported by a subfloor 100

(FIG. 4), such as plywood, cement, and the like. In some embodiments, the heating system is optionally supported by a previous floor 102 as long as the previous floor is sufficiently firm to provide a stable platform for the heater. Carpet is not recommended as a previous floor 102. Examples of previous floors 102 that can support the heating system include tiles, such as ceramic tiles 104 or sheet linoleum products.

A new decorative floor 106 to be warmed is placed on top of the heating system 35. Any flooring may be used as the decorative floor, including hard wood, sheet flooring, linoleum sheets or tiles, carpet, laminate floors, ceramic tiles 104 and the like. The ceramic tiles 104 are held in place by a mortar 108 under the tiles and grout 110 between the tiles.

The heater 26 is placed between the subfloor 100 and the new decorative floor 106. In some applications, it is adhered to the subfloor with an optional adhesive 112 (FIG. 2).

The bonding membrane 24 may include a basemat 36 and a coating 38 formed from a mixture of a hydraulic component, a polymer and water.

A preferred bonding membrane 24 is described in U.S. Pat. No. 7,347,895, issued Mar. 23, 2008 entitled "Flexible Hydraulic Compositions," and European Patent EP179179, and in pending U.S. Patent Application US2006/0054059 published Mar. 16, 2006 entitled "Flexible and Rollable Cementitious Membrane and Method of Manufacturing It", all herein incorporated by reference in their entireties and for all purposes. With the use of such a flexible cementitious membrane, the heater 26 may be put in the form of a roll with very small diameters (~≥1 inch). Further, such a membrane is extremely lightweight, having a weight of less than 500 pounds per thousand square feet, and down to less than 200 pounds per thousand square feet.

Any hydraulic components that include at least 55% fly ash may be useful in the coating 38. Class C hydraulic fly ash, or its equivalent, is the most preferred hydraulic component. This type of fly ash is a high lime content fly ash that is obtained from the processing of certain coals. ASTM designation C-618, herein incorporated by reference, describes the characteristics of Class C fly ash (Bayou Ash Inc., Big Cajun, II, La.). When mixed with water, the fly ash sets similarly to a cement or gypsum. Use of other hydraulic components in combination with fly ash are contemplated, including cements, including high alumina cements, calcium sulfates, including calcium sulfate anhydrite, calcium sulfate hemihydrate or calcium sulfate dihydrate, other hydraulic components and combinations thereof. Mixtures of fly ashes are also contemplated for use. Silica fume (SKW Silicium Becancour, St. Laurent, Quebec, CA) is another preferred material. The total composition preferably includes from about 25% to about 92.5% by weight of the hydraulic component.

The polymer is a water-soluble, film-forming polymer, preferably a latex polymer. The polymer can be used in either liquid form or as a redispersible powder. A particularly preferred latex polymer is a methyl methacrylate copolymer of acrylic acid and butyl acetate (Forton VF 774 Polymer, EPS Inc. Marengo, Ill.). Although the polymer is added in any useful amount, it is preferably added in amounts of from about 5% to 35% on a dry solids basis.

In order to form two interlocking matrix structures, water must be present to form this composition. The total water in the composition should be considered when adding water to the system. If the latex polymer is supplied in the form of an aqueous suspension, water used to disperse the polymer should be included in the composition water. Any amount of water can be used that produces a flowable mixture. Preferably, about 5 to about 35% water by weight is used in the composition.

Any well-known additives for cements or polymer cements can be useful in any of the embodiments of the instant composition to modify it for a specific purpose of application. Fillers are added for a variety of reasons. The composition or finished product can be made even more lightweight if lightweight fillers, such as expanded perlite, other expanded materials or either glass, ceramic or plastic microspheres, are added. Microspheres reduce the weight of the overall product by encapsulating gaseous materials into tiny bubbles that are incorporated into the composition thereby reducing its density. Foaming agents used in conventional amounts are also useful for reducing the product density.

Conventional inorganic fillers and aggregates are also useful to reduce cost and decrease shrinkage cracking. Typical fillers include sand, talc, mica, calcium carbonate, calcined clays, pumice, crushed or expanded perlite, volcanic ash, rice husk ash, diatomaceous earth, slag, metakaolin, and other pozzolanic materials. Amounts of these materials should not exceed the point where properties such as strength are adversely affected. When very thin membranes or underlayments are being prepared, the use of very small fillers, such as sand or microspheres are preferred.

Colorants are optionally added to change the color of the composition or finished basemat 36. Fly ash is typically gray in color, with the Class C fly ash usually lighter than Class F fly ash. Any dyes or pigments that are compatible with the composition may be used. Titanium dioxide is optionally used as a whitener. A preferred colorant is Ajack Black from Solution Dispersions, Cynthiana, Ky.

Set control additives that either accelerate or retard the setting time of the hydraulic component are contemplated for use in these compositions. The exact additives will depend on the hydraulic components being used and the degree to which the set time is being modified.

Reinforcing materials can be used to add strength to the basemat 36. The additional of fibers or meshes optionally help hold the composition together. Steel fibers, plastic fibers, such as polypropylene and polyvinyl alcohols, and fiberglass are recommended, but the scope of reinforcing materials is not limited hereby.

Superplasticizer additives are known to improve the fluidity of a hydraulic slurry. They disperse the molecules in solution so that they move more easily relative to each other, thereby improving the flowability of the entire slurry. Polycarboxylates, sulfonated melamines and sulfonated naphthalenes are known as superplasticizers. Preferred superplasticizers include ADVA Cast by Grace Construction Products, Cambridge, Mass. and Dilflo GW Superplasticizer of Geo Specialty Chemicals, Cedartown, Ga. The addition of these materials allows the user to tailor the fluidity of the slurry to the particular application.

Shrinkage reducing agents help decrease plastic shrinkage cracking as the coating 38 dries. These generally function to modify the surface tension so that the slurry flows together as it dries. Glycols are preferred shrinkage reducing agents.

While preferred, the basemat 36 need not be coated and may be coated on the jobsite using traditional mortars used for setting ceramic tile.

A preferred basemat 36 for the floor heater system 35 may include at least a first spunbond lamina 40. The first spunbond lamina 40 is optionally bonded directly to the conductive heater 26. In other embodiments, an optional meltblown lamina 42 resists migration of liquids through the basemat 36, adding to the resistance to the flow of water or other liquids across the bonding membrane 24. The first spunbond lamina 40 is placed on the top side of the meltblown lamina 42 to provide high porosity on at least one surface of the bonding membrane 24. Porosity of the spunbond material allows for good infiltration and absorption of the mortar 108. The large fibers become incorporated into the crystal matrix of the mortar 108, forming a strong bond.

Optionally, a second spunbond lamina 44 is present on the meltblown lamina 42 on the surface opposite that facing the first spunbond lamina 40. In this embodiment, the meltblown lamina 42 is sandwiched between the first spunbond lamina 40 and the second spunbond lamina 44. This embodiment has the advantage that it has the same surface on both sides and it does not matter which surface is applied to the conductive ink-based radiant heater 26 and which surface is facing the new decorative flooring 106.

The laminae 40, 42, 44 are bonded to each other by any suitable means. Three-ply composites or this type are commercially available as an S-M-S laminate by Kimberly-Clark, Roswell, Ga. This product is made of polypropylene fibers. While providing a barrier to liquids, the material is still breathable, allowing water vapor to pass through it. Depending upon the end application and the performance requirements, other lamina may be more suitable for a particular application. U.S. Pat. No. 4,041,203, herein incorporated by reference, fully describes an S-M-S laminate and a method for making it.

In a commercial scale production line, the basemat 36 is preferably made by a process beginning with unwinding the basemat 36 from a spool and running it toward the mixing area. If the basemat 36 is permeable by the slurry, an optional release paper is useful underneath the basemat to contain overspill of the slurry. With an impermeable basemat 36 and proper design of the coating station, the need for the release paper can be eliminated. The basemat 36 is aligned with and placed on a surface to be fed to coating equipment for application of the slurry.

The coating 38 is prepared by mixing the polymer and the hydraulic component in water. Preferably the mixing is done in a high shear mixer. Either a continuous or a batch mixer is useful, depending on the size of the batch being prepared.

The basemat 36 is provided and the coating 38 is applied to it. Any coating apparatus is adaptable for use with the coating slurry, including rod coaters, curtain coaters, sprayers, spreaders, extrusion, pultrusion, roller coaters, knife coaters, bar coaters and the like to coat the basemat 36 and form a sheet. One preferred method of spreading the slurry is by utilizing a screed bar. The screed bar can be metal, plastic, rubber or any material that scrapes excess coating from the basemat 36. A thin coating is obtained by keeping the screed bar in contact with the basemat 36. As a head of slurry builds up in front of the screed bar, the slurry spreads and uniformly covers the face of the basemat 36.

When spreading the slurry, it can be advantageous to position the screed bar over a flexible surface or no surface at all. Pressure is applied to the screed bar to build up a head and to obtain a thin coating of slurry. In testing, when pressure was applied with the basemat 36 positioned over a firm surface, the basemat stopped moving and started to tear. Moving the coating operation to a portion of the line where the basemat 36 was supported by a flexible belt allowed sufficient pressure to be applied to the mat to obtain a thin coating without bunching or tearing of the basemat. It is also possible to coat the basemat 36 with no surface directly under the basemat. In this case, a screed bar or other coating device is positioned over the suspended basemat 36. A device for catching and recycling excess coating material is preferably positioned underneath, but not touching, the basemat 36.

Thicker coatings 38 of slurry are obtainable by repeating the coating process multiple times. Preferably, two screed stations are present for application of two coatings 38 that are substantially similar. If it is desirable to have a non-directional sheet, the cementitious slurry is applicable to both sides of the basemat 36.

After the slurry 38 has been applied to the basemat 36, it is allowed to dry, set and harden. Any method of drying the slurry is useful, including, air drying at room temperature, oven or kiln drying or drying in a microwave oven. When allowed to dry at room temperature, a membrane is ready to use, package or store in a few hours. More preferably, the coated mat or coated paper is sent to an oven where it dries and sets rapidly. A slurry 38 thinly applied to a basemat 36 dries in less than 10 minutes in a 175° F. (80° C.) oven. The polymer is also curable using light, particularly light in the ultraviolet wavelength range. If the coating 38 is made with hot polymer, curing time is decreased, but the pot life is also decreased. Exact drying times will depend on the exact composition chosen, the thickness of the slurry and the drying temperature. When the composition is set, the release paper, if present, is removed by conventional methods.

Use of many types of heaters is contemplated for the present invention. Suitable radiant heaters are made using electrical cables either alone or positioned on a mesh or scrim. Any electrical radiant heater mat that is thin and cuttable may be used in this application. A preferred heater utilizes a conductive ink to form the heater. This technique makes a very thin heating system that does not significantly increase the height of the floor under which it is installed.

Several different types of conductive ink-based radiant heaters 26 are sold commercially. One type of conductive ink-based radiant heater 26 is printed with a carbon-based ink having a variety of resistances. Another type of conductive ink-based radiant heater 26 is printed with silver-containing inks having a variety of resistances. Yet another conductive ink-based radiant heater 26 is a circuit printed onto a polyester film.

Figure 3:
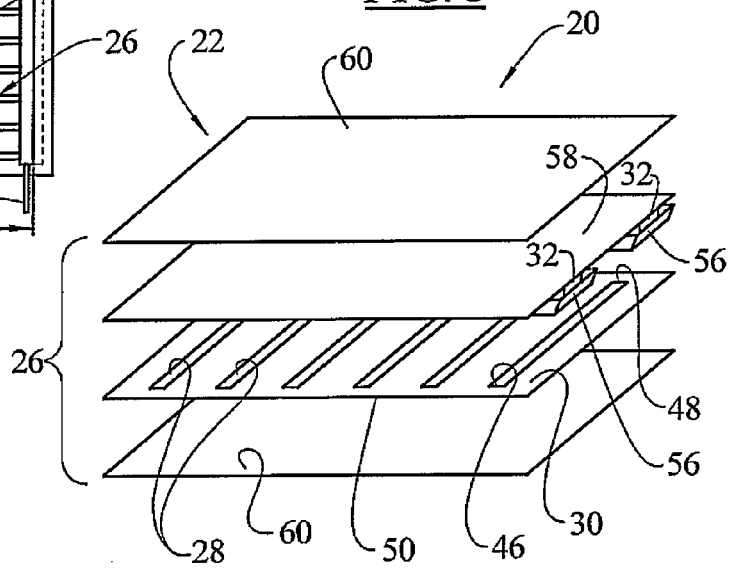
FIG. 3 is an exploded view of the conductive ink-based heating element.

Referring now to FIG. 3, a preferred conductive ink-based radiant heater 26 is similar to that marketed by Calesco Norrels (Elgin, Ill.). Heating is provided by printed ink resistive strips 28 on the first polymer sheet 30. The resistive strips 28 are placed on the polymer sheet 30 using any known method. One technique of laying down the resistive strips 28 is by printing them with a carbon-based ink. The conductive ink is selected to form a resistive material when dry and to adhere to the first polymer sheet 30 so that it does not flake off or otherwise become detached when the conductive ink-based radiant heater 26 is flexed. In an embodiment, the polymer sheet 30 may be made of polyester.

Figure 7:
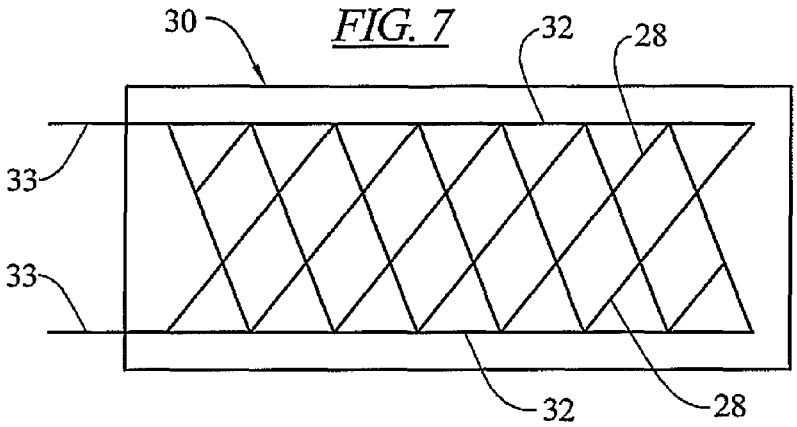
FIG. 7 is a schematic plan view of a heater with an alternative embodiment of the heating strip layout.

The electrically resistive strips 28 of the heater 26 may be arranged parallel to one another and may terminate at ends 46, 48 spaced from a perimeter edge 50 of the polymer sheet 30. In other embodiments (see FIG. 7), the strips 28 may crisscross one another, or they may have a serpentine or other non-linear shape.

Figure 5:
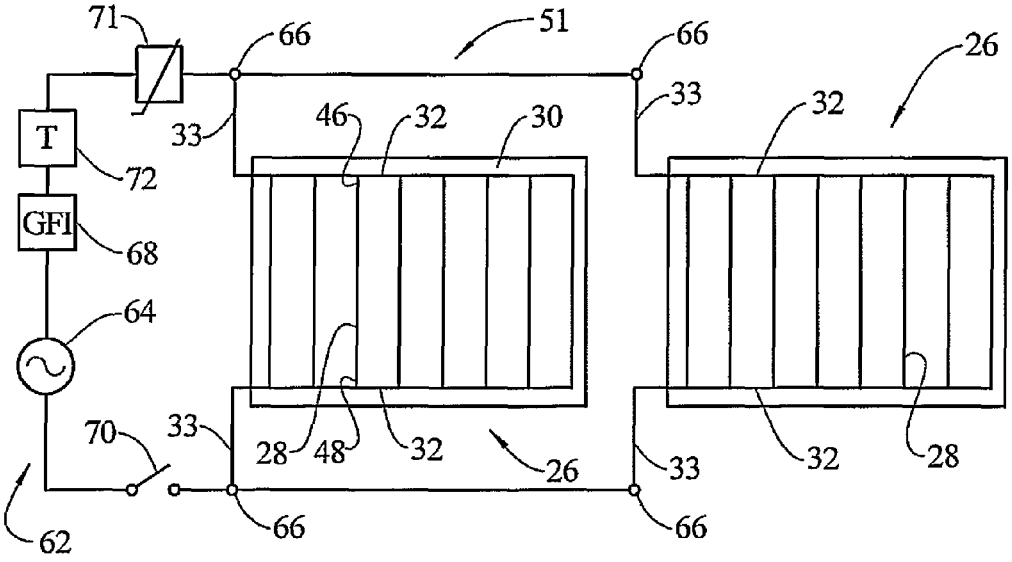
FIG. 5 is a schematic view of an electrical circuit incorporating the heating system of the present invention.

The resistive strips 28 are incorporated into an electrical circuit 51 using at least two buses 32 as shown in FIG. 5. One bus 32 is placed at or near each end 46, 48 of the resistive strips 28 on the opposite side of the resistive strip from the polymer sheet 30. Additional buses 32, for example connecting the mid-points of the resistive strips 28, may be added as desired. Use of additional buses 32 in this manner minimizes the area of the sheet 30 that does not provide heat when part of a bus 32 is cut away during fitting as described below. An example of a preferred bus 32 is a strip of copper foil or other conductive material. The copper strips of the buses 32 may terminate at ends 52, 54 spaced from the perimeter edge 50 of the polymer sheet 30. In other embodiments, one end 52 of the buses 32 may extend all the way to the edge 50 of the polymer sheet 30 to act as the conductors 33 as described above.

If needed, a thin conductive material 56 is placed between the resistive strips 28 and the bus 32 where they intersect to promote good conductivity between them. Preferably the conductive material 56 is a conductive polymer. Common classes of organic conductive polymers include poly(acetylene)s, poly(pyrrole)s, poly(thiophene)s, poly(aniline)s, poly(fluorene)s, poly(3-alkylthiophene)s, polytetrathiafulvalenes, polynaphthalenes, poly(p-phenylene sulfide), and poly(para-phenylene vinylene)s. In any event, it is preferred that the connection between the buses 32 and the strips 28 is made in a waterproof manner.

The buses 32 and the conductive material 56 may be bonded to a second polymer sheet 58. When the conductive ink-based radiant heater 26 is assembled, the second polymer sheet 58 is arranged so that the conductive material 56 is adjacent to the resistive strips 28 on the first polymer sheet 30 so that the second polymer sheet will overlie the resistive strips 28 and the buses 32. The polymer sheets 30, 58, when made of a waterproof material, will render the connection between the buses 32 and the resistive strips 28 waterproof.

To protect the circuit materials from being damaged or scratched during installation, in an embodiment, the polymer sheets 30, 58, resistive strips 26, buses 32 and conductive material 36 may be covered by one or encapsulated between two additional plastic sheets 60. Preferably the plastic sheets 60 and the polymer sheets 30, 56 are laminated together. An example of a suitable plastic sheet 60 is a sheet of polyethylene film. In order to provide a measure of water impermeability to the panels 22 that incorporate the plastic sheets 60, the plastic sheets may be water impermeable. Sealing of the buses 32 and the resistive strips 26 within the plastic sheets 60 also allows the conductive ink-based heater to be used in wet environments and promotes long life. A wire 33 attached to each of the buses 32 extends outside of the plastic sheets 60. These wires 33 are used to electrically attach the finished panels 22 of the heating system 20 to each other and to a circuit 62 providing an electrical current, such as a house circuit.

The circuit 62 includes a voltage source 64 to provide an electrical current. The heaters 26 are connected to each other in parallel in the circuit such that the addition of heaters 26 to the circuit will not reduce the voltage drop across any of the heaters, thereby maintaining the current passing through each heater and maintaining a heat flux produced by each heater. In this manner, any number of heaters 26 may be added to a circuit (as permitted by the total current load permitted for the circuit) as is necessary to underlie a desired portion of the floor and to provide a desired level of heat into the room where the floor is located. Other components of the circuit 62 are discussed below.

Figure 6:
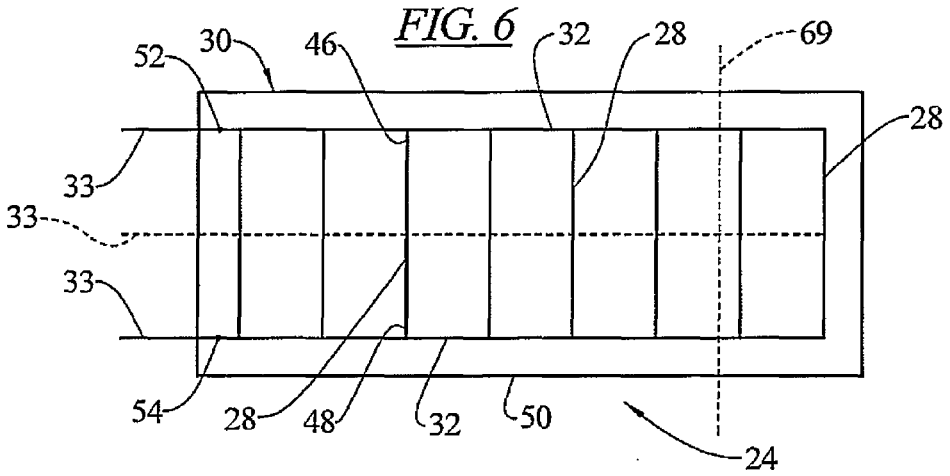
FIG. 6 is a schematic plan view of a heater illustrating a place for trimming the heater.

The heaters 26 may be constructed in a manner so as to provide a predetermined heat flux by selecting an appropriate conductive ink and selecting a width, thickness and length of the strips 26. Inks having different surface resistances can be selected and the width and thickness of the strips 26 can be chosen to produce a desired resistance, which will translate into a desired heat output for each strip. The strips 26 can be arranged with selected spacings there between to produce a desired heat output for the panel 22. If a center bus 32 is utilized (as shown in phantom in FIG. 6), the width and thickness of the strips 26 will be adjusted to accommodate the shortened length of the strips between the buses. Also in such an arrangement, the outside buses would be connected to the same power supply connection, while the center bus would be connected to an opposite power supply connection.

Figure 4:
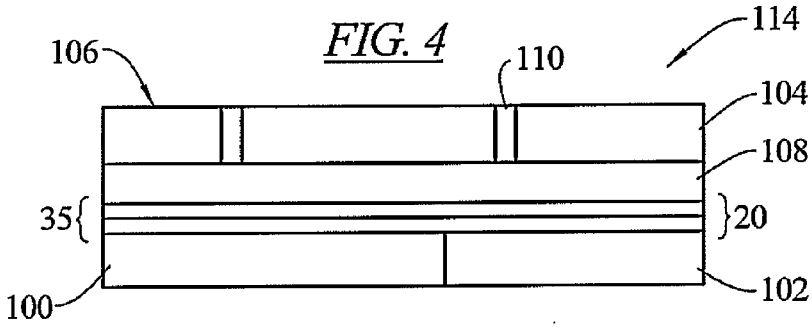
FIG. 4 is a cross-section of a heated floor using the heating system of the present invention.

Referring to FIG. 4, a heated floor, generally 114, is made using the floor heating system 20. The heating system 20 is placed between the subfloor 100 and the decorative flooring 106. Depending on the decorative flooring 106 selected, it may not be necessary to use the adhesive 112 to bond the heating system 20 to the subfloor 100. Where, for example, a laminate floor, such as PERGO is selected as the decorative flooring 106, the floor heating system 20 can be placed between the subfloor 100 and the laminate floor 106 with no bonding. In this case, movement of the heater 26 with respect to the decorative flooring 106 or the subfloor 100 causes no harm.

However, where ceramic tile 104 is selected as the decorative flooring, stabilization of all materials under the tile is important. In this case, it is important that there be the adhesive 112 between the subfloor 100 and the heating system 20 as described above. The heating system 20 is also advantageous when used under ceramic tile 104 as the bonding membrane 24 is a particularly good surface for adhesion of the mortar 108 that holds the ceramic tile 104 in place.

To prepare the heated floor 114, the heating system 20 is placed under the decorative floor 106 by any method known in the art. In some embodiments, sheets of the heating system 20 are laid out on the subfloor 100 or previous floor 102 and cut to length. The resistive strips 28 and the buses 32 in the panels 24 are spaced from the perimeter edge 34 of the panels to provide electrical insulation and isolation of those components. If the panels 24 need to be cut to fit a particular installation requirement, the panels are to be cut along a line (such as line 69 in FIG. 6) parallel to the resistive strips 28, in those embodiments where the strips are spaced and parallel to each other. This will result in two exposed portions of the buses 32 which will need to be insulated and isolated from the cut edge of the panel, such as with insulating tape, a liquid non-conductive polymer, or other known methods of electrical insulation. If the size of the installation requires cutting of the panel 24 along its length (cutting though all of the resistive strips 28), then it is preferred to obtain a narrower prefabricated panel, or to limit the area under the floor provided with the heater 26, in order to avoid having to electrically insulate the large number of exposed ends of the cut strips. Since the panels are to be joined together in a circuit with parallel connections, extra panels can be added as needed.

The floor heating system 20 is then optionally bonded to the subfloor 100 with the adhesive 112. Mechanical fasteners (not shown), such as nails or screws, are also used if desired. A thermister 71 is placed on the floor 100, 102 to monitor and self-regulate the heaters 26. The new decorative floor 106 is placed on top of the sheets 30 or 60 of the floor heating system 20. In the case of ceramic tiles 104, the mortar 108 is spread over the sheets of floor heating system 20 and the ceramic tiles 104 installed with grout 110. Wires 33 attached to the buses 32 are hooked to an electrical junction 66, and a ground fault circuit interrupter 68 to complete the circuit. Preferably the circuit includes a switch 70 for ease in activating and deactivating the heating system 20. The wires 33 may be a part of a wiring harness which may be color coded for ease of installation by the floor installer.

In addition, a thermostat 72 is installed to monitor temperatures in the space where the floor is located. This thermostat 72 controls on and off conditions for the heating system 20. Components for controlling floor heaters are commercially available from Honeywell Corp. (Morristown, N.J.).

Figure 8:
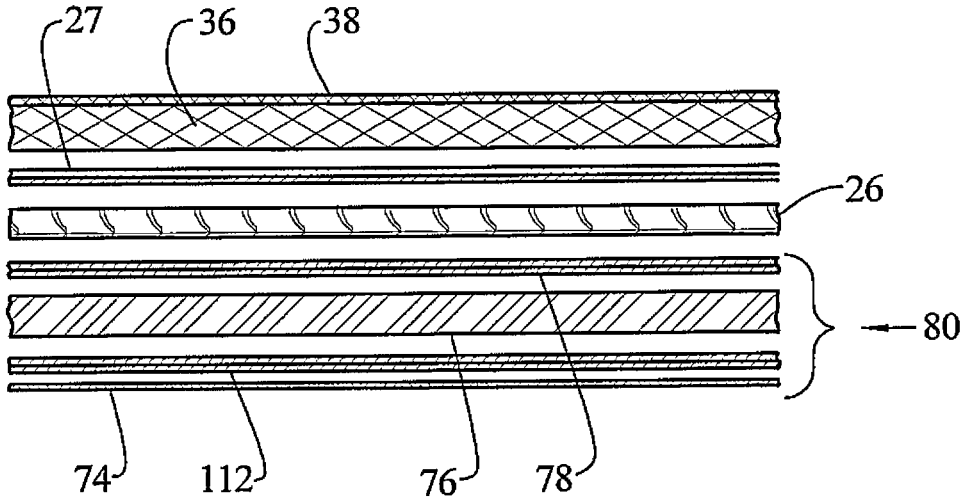
FIG. 8 is a cross-section of an alternative embodiment of a heater of the present invention.

An alternate embodiment of the heating system is illustrated in FIG. 8. In this embodiment, there are multiple layers as described above including a flexible cementitious coating 38, a single or multi-layered base mat 36, an adhesive layer 27, an electric radiant heat mat 26, an optional adhesive layer 112 and an optional release liner 74. A new functional layer 76 is provided and adhered to the heat mat 26 via an adhesive layer 78 which may provide a single function or multiple functions.

For example, layer 76 may have sound suppression properties, it may comprise thermal insulation, it may comprise electrical insulation, it may provide waterproofing and it may provide enhanced crack isolation. Further, this layer 76 may provide more than one of the above properties by means of individual component layers or more than one of these properties might be provided in a single layer. Further the adhesive layers 78 and 112 (and release liner 74) as well as the functional layer 76 may be combined in a single composite laminate 80 to be adhered to the radiant heat mat 26.

As examples of possible components comprising the functional layer 76, the sound suppression properties, particularly for impact noise, could be achieved with a layer of low density foam, rubber or plastic. The adhesive layers 78 and 112 securing the functional layer 76 to the electric radiant heat mat 26 and to the sub floor 100 (if used) could be pressure sensitive adhesive transfer tape or pressure sensitive double sided adhesive tape or even spray or liquid applied adhesives. The use of double sided adhesive tapes are preferred when enhanced crack-isolation and waterproofing performance are desired. Low density foams, which also may provide thermal insulation and/or electrical insulation, may include polyethylene foams such as 3M polyethylene foam tape 4462 or 4466, polyurethane foams such as 3M urethane foam tape 4004 or 4008, polyvinyl foams such as 3M polyvinyl foam tape 4408 or 4416, ethylene vinyl acetate foams such as International Tape Company polyethylene foam tapes 316 or 332, acrylic foams such as 3M VHB 4941 closed-cell acrylic foam tape family, and EPDM (ethylene propylene diene monomer) foams such as Permacel EE1010 closed cell EPDM foam tape. Silicone foams include Saint-Gobain 512AV.062 and 512AF.094 foam tapes. Rubber foams include 3M 500 Impact stripping tape and 510 Stencil tape. Elastomeric foams include 3M 4921 elastomeric foam tape and Avery Dennison XHA 9500 foam tape. Rubber or recycled rubber sheets can be obtained from Amorim Industrial Solutions or IRP Industrial Rubber.

The use of the adhesive layer 112 and the release sheet 74 allows the panels to be self-adhering to a desired substrate surface, in the nature of a peal and stick arrangement. This permits the installer to quickly place the panels in their desired locations without the need for mixing or applying adhesive materials and assures that the adhesives adequately cover the panels and are applied in the correct amounts.

Figure 9:
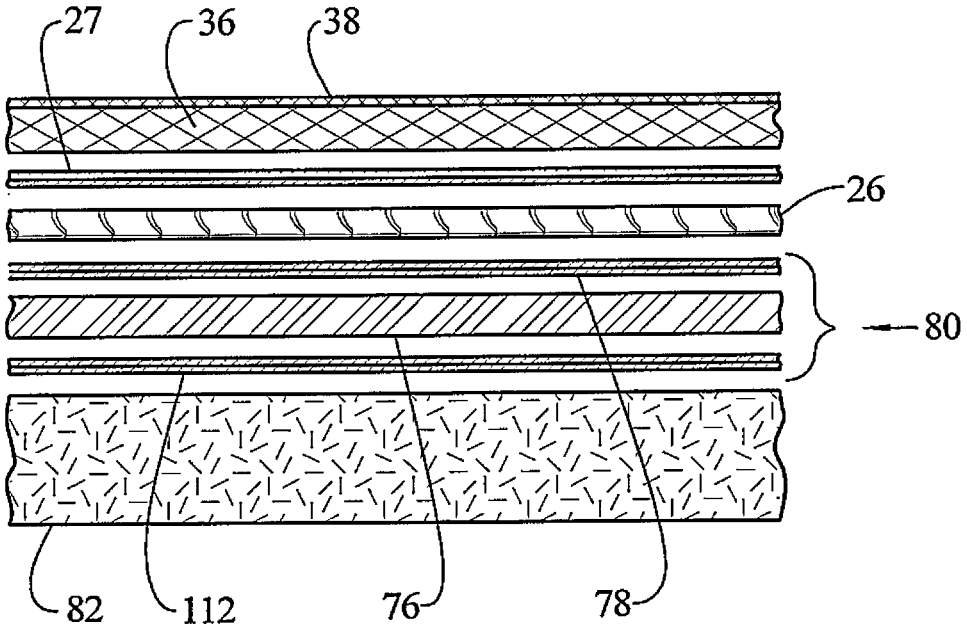
FIG. 9 is a cross-section of another embodiment of a heater of the present invention.

A further embodiment of the invention is illustrated in FIG. 9 which has all of the layers described with respect to FIG. 8 (other than the release sheet 74). In addition, this embodiment includes a rigid panel composite layer 82 by means of which the heating system 20 is provided on a building panel that can be incorporated into floors, walls, ceilings and other structural components of a building. The rigid panel composite layer 82 may comprise mesh reinforced cement board, fiber reinforced cement board, gypsum panels, gypsum fiber panels, plywood, oriented strand board or other types of wood-based panels, plastic panes as well as other types of rigid panel composites. The panel thicknesses may range between 0.125 to 10 inches, preferably between 0.250 to 2 inches and most preferably between 0.250 and 1 inches.

While a particular embodiment of a heating system and heated floor have been shown and described, it will be appreciated by those skilled in the art that changes and modifications may be made thereto without departing from the invention in its broader aspects.

What is claimed is:

1. A heating system comprising:

a bonding membrane comprising a water permeable lamina;

an electrically conductive ink-based radiant heater; and a first adhesive adapted to adhere to both said conductive ink-based radiant heater and said bonding membrane.

2. The system of claim 1 wherein said bonding membrane comprises a basemat and a coating.

3. The system of claim 1 wherein said conductive ink-based radiant heating element further comprises a polymeric sheet onto which resistive strips have been printed with a conductive ink.

4. The system of claim 1 further comprising a multi-functional layer that is adhered to the radiant heater using a second adhesive.

5. The system of claim 2 wherein said basemat comprises a meltblown lamina sandwiched between two spunbond laminae.

6. The system of claim 2 wherein said coating comprises at least 55% of a hydraulic component selected from the group consisting of fly ash and silica fume.

7. The system of claim 3 further comprising at least two buses to supply current to or remove current from said resistive strips.

8. The system of claim 4 wherein said multi-functional layer comprises one of the group consisting of a low density foam, a polymeric sheet, a rubber sheet and combinations thereof.

9. The system of claim 6 wherein said coating further comprises a water-soluble, film-forming polymer.

10. The system of claim 7 further comprising a conductive material between said resistive strips and said buses.

11. A floor comprising:

a substrate;

a heating system comprising:

a bonding membrane comprising a water permeable lamina;

an electrically conductive ink-based radiant heater; and a first adhesive adapted to adhere to both said conductive ink-based radiant heater and said bonding membrane; and a decorative floor surface.

12. The floor of claim 11 wherein said decorative floor surface is ceramic tile or natural stone, and wherein said floor further comprises an adhesive positioned between said substrate and said heating system and a mortar between said heating system and said ceramic tile or natural stone.

13. A heating system in the form of a multilayer panel comprising:

a bonding membrane comprising a water permeable lamina;

an electrically conductive ink-based heater including a plurality of electrically resistive strips printed on a first polymer sheet connected by electrically conductive buses; and electrical conductors extending from said buses to at least an edge of said panel.

14. A heating system according to claim 13, wherein said plurality of resistive strips are arranged parallel to one another and terminate at ends spaced from a perimeter edge of said polymer sheet.

15. A heating system according to claim 13, further including a second polymer sheet overlying said resistive strips and buses.

16. A heating system according to claim 13, wherein said bonding membrane comprises a basemat and a coating formed from a mixture of a hydraulic component, a polymer and water.

17. A heating system according to claim 13, wherein said panel includes a layer of from the group consisting of thermal insulation, sound suppression material, waterproofing material, electrical insulation and crack isolation material.

18. A heating system according to claim 13, wherein said panel includes a layer of adhesive material on one outer surface.

19. A heating system according to claim 14, wherein two buses are provided, one at each end of said resistive strips.

20. A heating system according to claim 15, further including at least one additional plastic sheet encapsulating said first and second polymer sheets and the resistive strips and buses, said additional sheet being selected from the group consisting of water impermeable sheets and sheets having a low dielectric constant.

* * * * *